US005304037A

United States Patent [19]

Scofield

[11] Patent Number: 5,304,037

[45] Date of Patent: Apr. 19, 1994

[54] CEILING FAN BLADE VIBRATION ISOLATION SYSTEM

[75] Inventor: Robert L. Scofield, Cordova, Tenn.

[73] Assignee: Hunter Fan Company, Memphis, Tenn.

[21] Appl. No.: 48,282

[22] Filed: Apr. 14, 1993

[51] Int. Cl.[5] ..... F04D 29/66

[52] U.S. Cl. ..... 416/134 R; 416/5; 416/210 R; 416/214 R; 416/500

[58] Field of Search ..... 416/134 R, 5, 204 R, 416/210 R, 214 R, 500; D23/411, 413

[56] References Cited

U.S. PATENT DOCUMENTS

| | | | |
|---|---|---|---|
| 404,964 | 6/1889 | Elliott . | |
| 2,041,555 | 5/1936 | Lee . | |
| 2,119,398 | 5/1938 | Morse | 416/5 |
| 2,270,583 | 1/1942 | Forton . | |
| 2,299,010 | 10/1942 | Doman . | |
| 2,678,104 | 5/1954 | Davis . | |
| 2,702,087 | 2/1955 | Beier . | |
| 2,965,180 | 12/1960 | Killam . | |
| 2,987,242 | 6/1961 | Mazzacane . | |
| 3,033,049 | 5/1962 | Morrow | 416/5 |
| 3,893,555 | 7/1975 | Elmer . | |
| 4,396,352 | 8/1983 | Pearce | 416/5 |
| 4,511,310 | 4/1985 | Pearce . | |

FOREIGN PATENT DOCUMENTS 759535 1/1953 Fed. Rep. of Germany ... 416/214 R

*Primary Examiner*—Edward K. Look
*Assistant Examiner*—James A. Larson
*Attorney, Agent, or Firm*—Heiskell, Donelson, Bearman, Adams, Williams & Caldwell

[57] ABSTRACT

A medallion-style blade iron assembly for use on a ceiling fan includes a vibration isolation system for eliminating transmission of vibration from the fan motor to the blades. The assembly includes an arm securable to the fan motor and medallion securable to the arm, with the distal end of a blade being secured therebetween. A plurality of mounting holes are provided in the blade for allowing screws to be inserted through the arm into the medallion, with each hole have a resilient elastomeric grommet disposed therein. Each grommet has a pair of annular shoulders resting on the top and bottom surfaces of the blade, and a central tapered opening for receiving the frusto-conical bosses formed on the arm and medallion. The grommets prevent contact between the blade, the arm, and the medallion.

9 Claims, 2 Drawing Sheets

CEILING FAN BLADE VIBRATION ISOLATION SYSTEM

BACKGROUND OF THE INVENTION

1. Field

This invention relates to ceiling fans and, more particularly, to an isolation system for use with medallion-style blade irons in securing the blades to the motor.

2. Description of the Prior Art

The use of ceiling fans as supplementary means of conditioning air within both commercial and residential buildings has increased dramatically over the last several years. The growing popularity of ceiling fans has resulted in numerous improvements in virtually every aspect of these products, including both performance and appearance.

Once such improvement relates to the introduction of medallion-style blade irons, comprising separate arm and medallion components which interconnect on opposite sides of a blade. With the blade securely fixed between the arm and medallion, the arm is attached to the fan motor in a generally conventional manner. Medallion-style blade irons provide a distinct departure from conventional blade irons, particularly in appearance.

Another improvement has been the use of elastomeric isolation systems with conventional blade irons to reduce the transmission of vibration from the motor through the blade iron to the blade. As those skilled in the art readily appreciate, transmission of vibration to a ceiling fan blade significantly increases the noise caused by the fan and seriously detracts from the performance and desirability of the fan. Prior to the development of the present invention, however, there has been no known method of isolating a blade from a medallion-style blade iron. Accordingly, a significant deficiency has been recognized in the prior art.

BRIEF SUMMARY OF THE INVENTION

An object of this present invention is to provide an improved medallion-style blade iron having a vibration isolation system.

Another object of this invention is to provide a medallion-style ceiling fan wherein both the arm member and medallion member are isolated from the blade by suitable elastomeric means.

A further object is to provide such a blade iron assembly having elastomeric grommets which also isolate the arm member from the medallion member.

Yet another object is to provide unique isolation grommets which facilitate assembly of the medallion to the arm, while isolating the components from the blade.

The foregoing and other objects are accomplished in the present invention, which provides a novel blade iron assembly for use in securing a blade to the motor of a ceiling fan. This invention comprises a medallion-style blade iron, having an arm securable directly to the motor of a ceiling fan and a medallion securable to the distal end of the arm, with a blade sandwiched therebetween. A plurality of holes are formed through the end of the blade, through which screws may be inserted to fasten the medallion to the arm. A plurality of resilient elastomeric grommets are inserted through the holes in the blade, having specially configured holes formed therethrough for receiving bosses formed on the arm and medallion to facilitate assembly and effectively isolate the blade from both the medallion and arm, and to further isolate the medallion from the arm.

DETAILED DESCRIPTION OF THE PREFERRED EMBODIMENT

Figure 1:
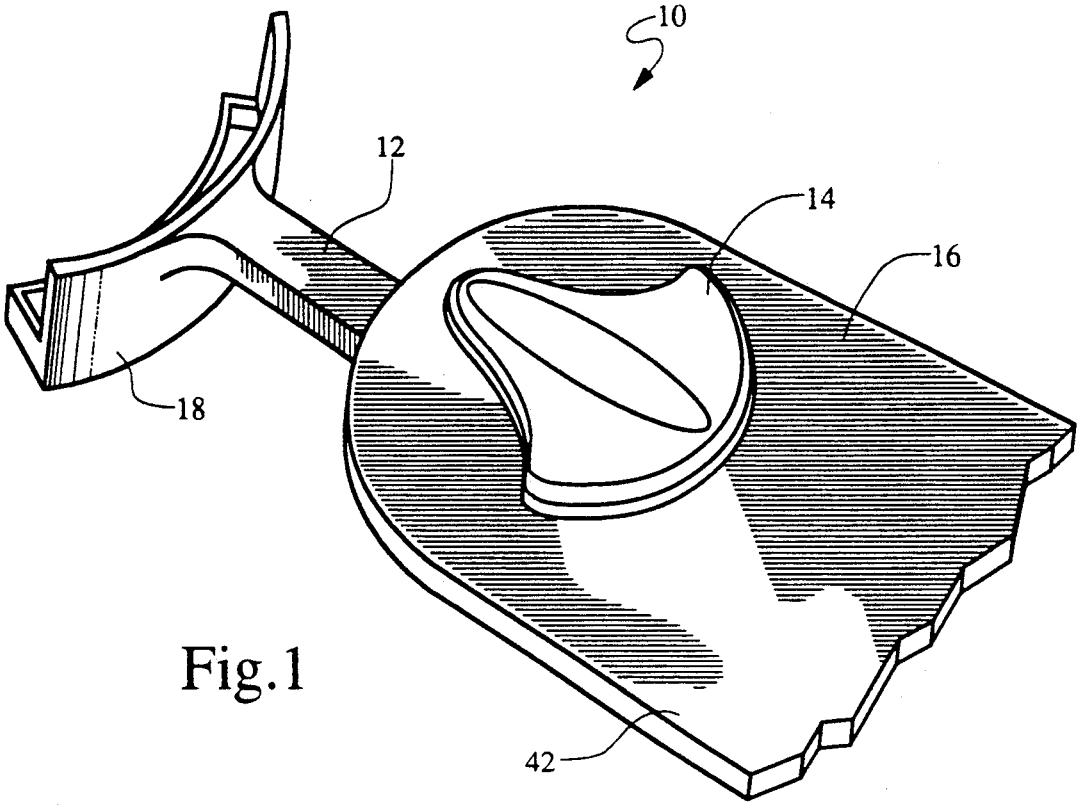
FIG. 1 is a bottom perspective view of the blade iron assembly according to the present invention.
Figure 2:
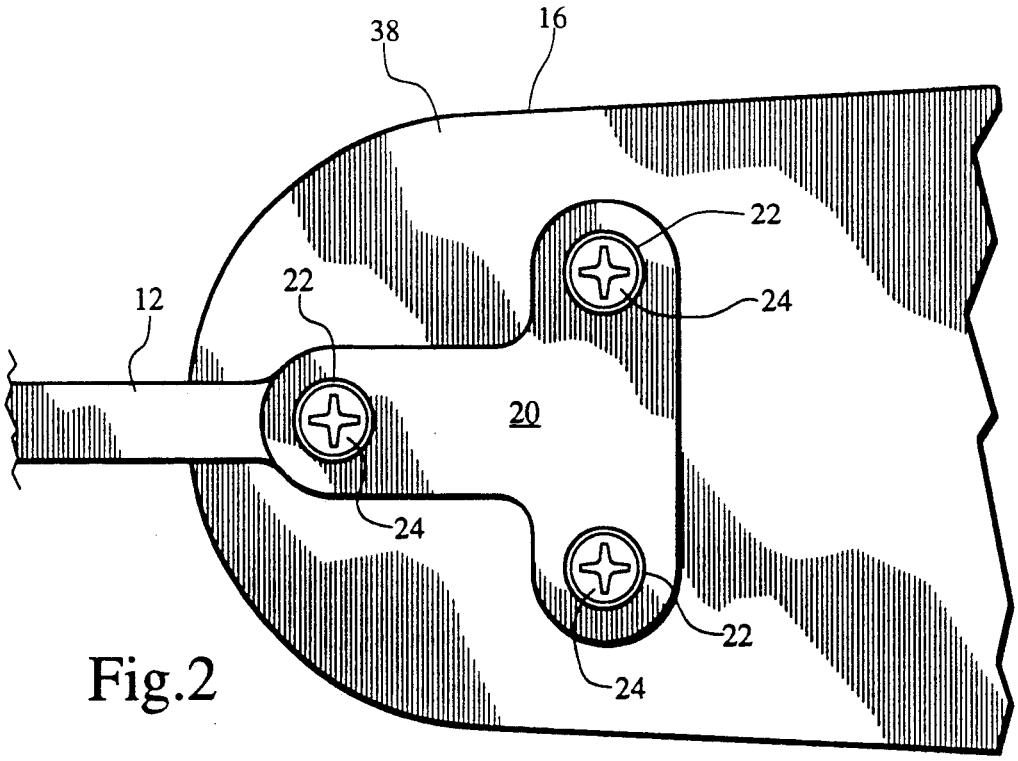
FIG. 2 is an enlarged top plan view of the blade iron assembly.

As best shown in FIGS. 1 and 2, the present invention is a blade iron assembly identified generally by reference numeral 10, comprising an arm 12 and medallion 14, with the proximate end of a generally conventional blade 16 secured therebetween. The proximate end 18 of arm 12 is adapted for attachment to a conventional ceiling fan motor (not shown), and the precise configuration of proximate end 18 may vary considerably from one assembly to another. It will be readily appreciated by those skilled in the art that the configuration of proximate end 18 is largely irrelevant for purposes of this invention, which deals primarily with the isolation system as discussed in more detail below.

Figure 3:
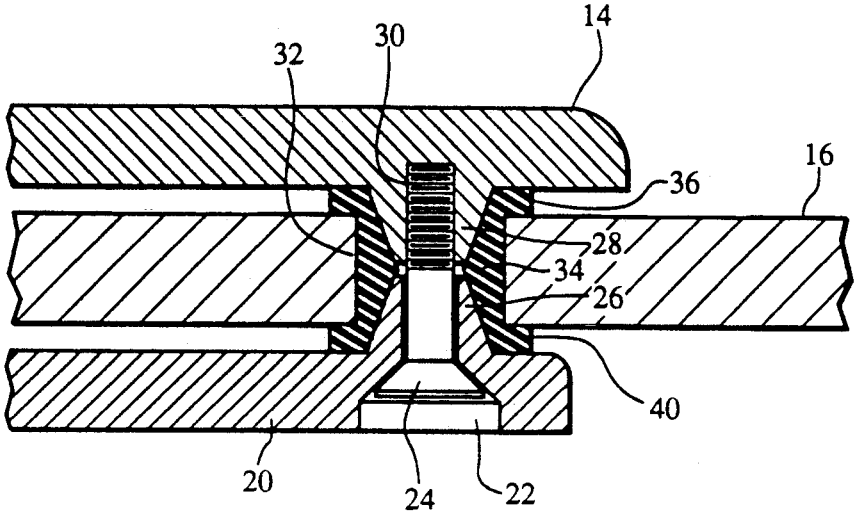
FIG. 3 is an enlarged side sectional view through a portion of the blade iron assembly of this invention, in its assembled condition.
Figure 4:
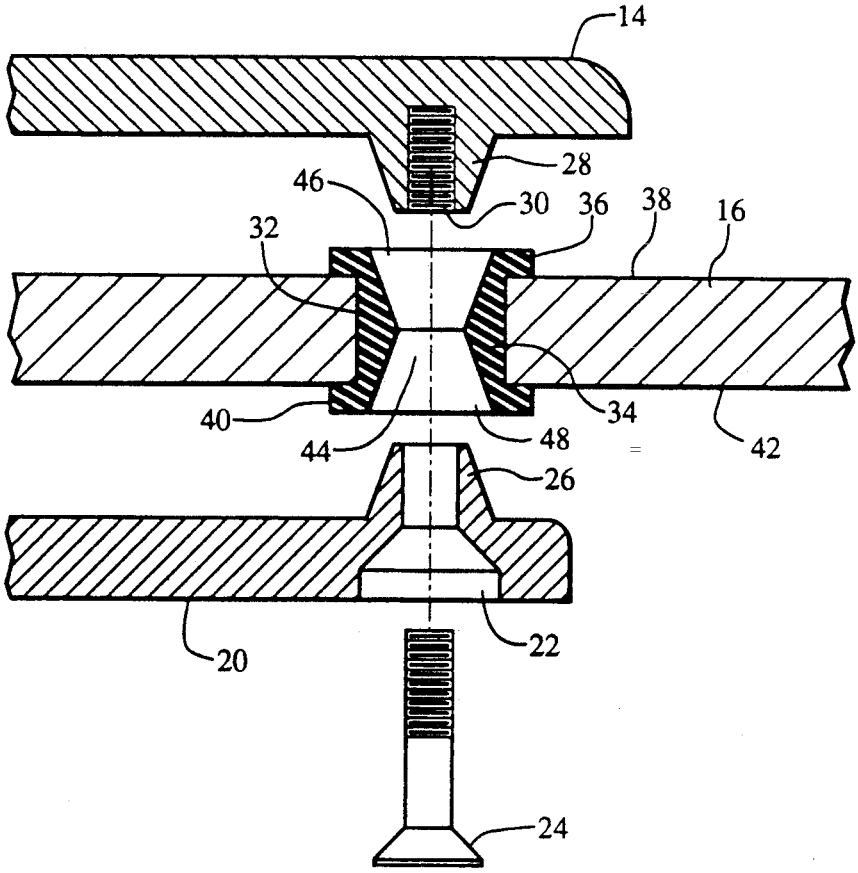
FIG. 4 is an exploded sectional view of the present blade iron assembly similar to FIG. 3.

In the preferred embodiment shown, the distal end 20 of arm 12 has three holes 22 formed therein through which screws 24 are inserted for attachment of arm 12 to medallion 14. As best shown in FIGS. 3 and 4, distal end 20 includes a boss 26 formed annularly about each hole 22. Medallion 14 includes an equal number of bosses 28 formed therein, each boss 28 having a threaded receptacle 30 formed therein for engaging screw 24. In the embodiment shown, there are three mounting holes 32 formed in the proximate end of blade 16, with an equal number of bosses 26 and 28 alignable therewith and three screws 24 insertable therethrough. While it has been found advantageous to have three mounting holes 32 and related components, it will be clear to those skilled in the art any number of mounting holes may be provided without departing from the teachings of this invention.

FIGS. 3 and 4 depict a cross-sectional view through a representative mounting hole 32 to illustrate the preferred vibration isolation means of the present invention. It is to be understood that the details of the assembly shown in FIGS. 3 and 4 are equally applicable to all three mounting holes 32 in blade 16, and are intended to apply regardless of the number of said mounting holes 32.

Inserted within each mounting hole 32 is a resilient elastomeric grommet 34, having an annular shoulder 36 resting against bottom surface 38 of blade 16, and annular shoulder 40 resting against top surface 42. Grommet 34 has an axial hole 44 formed therein, through which screw 24 is inserted for engagement with threaded receptacle 30. As shown in FIG. 3, shoulders 36 and 40 effectively isolate medallion 14 and distal end 20 of arm 12 from blade 16, thereby significantly reducing the transmission of unwanted vibration from the ceiling fan motor to blade 16.

In the preferred embodiment of this invention, bosses 28 and 26 have a frusto-conical exterior configuration. Top opening 46 and bottom opening 48 of axial hole 44 have similar frusto-conical interior surfaces for serving as mating receptacles for bosses 28 and 26, respectively. The central body portion of grommet 34 has a cylindrical exterior configuration conforming generally to the shape of mounting hole 32, and axial hole 44 is tapered to a reduced diameter at its center due to the unique configuration of openings 46 and 48. The formation of bosses 26 and 28 and opening 46 and 48 in this manner allows the effective transfer of compressive load through grommet 34 to ensure the structural integrity of assembly 10, and prevents contact between bosses 26 and 28 to further isolate blade 16 from vibration. Additionally, the tapered receptacles formed by openings 46 and 48 facilitate the assembly of arm 12 and medallion 14 by simultaneously centering all bosses 26 and 28 within holes 44, and aligning holes 22 with threaded receptacles 30 as required for proper installation of screws 24.

While the principles of providing a vibration isolation system for a medallion-style blade iron have been made clear from the accompanying drawings and detailed description set forth herein, it is to be understood that many variations in the preferred embodiment are contemplated which come within the scope of this invention. Accordingly, the coverage provided by this patent should be limited only by the scope of the appended claims, and not the specific embodiment disclosed herein.

What is claimed is:

1. A blade iron assembly for use is securing a blade to a ceiling fan motor, said blade having generally planar front and back sides and a plurality of mounting holes formed through a proximate end thereof, said assembly comprising:

an arm member having a proximate end adapted for attachment to said motor and a distal end extending radially from said motor, said distal end having a plurality of bosses formed therein equal in number and alignable with said mounting holes in said blade, each said boss having a through hole formed therein;

a medallion member having a plurality of bosses formed therein equal in number and alignable with said mounting holes, each said boss having a threaded receptacle formed therein;

a plurality of screws, equal in number to said mounting holes, said medallion member and said arm member being securable to the front and back sides of said blade by aligning said bosses of said arm member with said bosses of said medallion member, with said mounting holes aligned therebetween, inserting said screws through said through holes in said arm member, and engaging said screws with said threaded receptacles in said medallion member; and isolation means insertable in said mounting holes, operative to prevent said arm member and said medallion member from contacting either said front or back side of said blade.

2. A blade iron assembly as set forth in claim 1, wherein:

said isolation means are further operative to prevent said bosses of said arm member from contacting said bosses of said medallion member.

3. A blade iron assembly as set forth in claim 1, wherein:

said bosses in said arm member and said medallion member have frusto-conical exterior configurations; and said isolation means comprise a plurality of grommets formed from a resilient compound, insertable within said mounting holes, each said grommet having:

a pair of axially spaced shoulders at opposite ends thereof, disposed annularly about one of said mounting holes on said front and back sides of said blade upon insertion of said grommet within said mounting hole; and an axial opening for receiving an aligned pair of said bosses therein, said opening being centrally tapered to generally conform to the frusto-conical configuration of said bosses so that one of said arm member bosses and one of said medallion member bosses are seatable within said opening from opposite ends thereof, said grommet being adapted to prevent contact between said arm member boss and said medallion member boss.

4. A blade iron assembly as set forth in claim 3, wherein:

said shoulders are operative to prevent said medallion member and said arm member from contacting said front and back sides of said blade.

5. A blade iron assembly as set forth in claim 3, wherein said grommets are formed of rubber.

6. A blade iron assembly as set forth in claim 1, wherein the number of said through holes is three.

7. A medallion-style blade iron assembly, comprising an arm securable to a ceiling fan motor and a medallion securable to said arm, with a ceiling fan blade being retained therebetween, said blade having a plurality of mounting holes formed therein for allowing the attachment of said arm to said medallion, said arm and said medallion have a plurality of bosses formed thereon, said bosses on said arm being alignable with said bosses on said medallion on opposite sides of said blade, with said mounting holes being alignable therebetween said assembly having a vibration isolation system comprising:

a plurality of grommets, each having a cylindrical central portion with an annular shoulder and an axial opening at each end thereof, insertable within said mounting holes in said blade, adapted to prevent contact between said blade, said arm, and said medallion, thereby reducing the transmission of vibration from said motor to said blade, wherein;

said axial opening at each end of each said grommet is adapted to receive one of said bosses, said plurality of grommets being operative to prevent said bosses on said arm from contacting said bosses on said medallion.

8. An assembly as set forth in claim 7, wherein:

said annular shoulders on said grommets are operative to prevent contact between said blade, said arm, and said medallion.

9. An assembly as set forth in claim 7, wherein:

said axial opening at each end of each said grommet has a frusto-conical configuration, and said axial openings at opposite ends of each said grommet are contiguous, meeting in the middle of said cylindrical central portion to form an axial hole therethrough.

* * * * *